US007168341B2

(12) United States Patent
More

(10) Patent No.: US 7,168,341 B2
(45) Date of Patent: Jan. 30, 2007

(54) TORQUE WRENCH

(75) Inventor: Nicholas More, Felton (GB)

(73) Assignee: Torque Tension Systems Limited, Northumberland (GB)

( * ) Notice: Subject to any disclaimer, the term of this patent is extended or adjusted under 35 U.S.C. 154(b) by 0 days.

(21) Appl. No.: 10/311,173

(22) PCT Filed: Jun. 8, 2001

(86) PCT No.: PCT/GB01/02651

§ 371 (c)(1),
(2), (4) Date: Jul. 14, 2003

(87) PCT Pub. No.: WO01/96072

PCT Pub. Date: Dec. 20, 2001

(65) Prior Publication Data

US 2004/0060397 A1 Apr. 1, 2004

(30) Foreign Application Priority Data

Jun. 13, 2000 (GB) ..... 0014416.2

(51) Int. Cl.
*B25B 13/46* (2006.01)

(52) U.S. Cl. ..... 81/57.39

(58) Field of Classification Search ..... 81/57.39, 81/58, 60

See application file for complete search history.

(56) References Cited

U.S. PATENT DOCUMENTS

| | | | | |
|---|---|---|---|---|
| 4,027,561 | A | 6/1977 | Junkers | 81/57.39 |
| 4,079,641 | A | 3/1978 | Junkers | 81/57.39 |
| 5,005,447 | A * | 4/1991 | Junkers | 81/57.39 |

* cited by examiner

*Primary Examiner*—D. S. Meislin
(74) *Attorney, Agent, or Firm*—Zilka-Kotab, PC

(57) ABSTRACT

A torque wrench for applying torque to a component (21) is described. The torque wrench has an engaging member (18) for engaging the component (21) to be rotated about an axis (22) and a ratchet member (25) connected to the engaging member (18). A drive lever (14) is connected to the engaging member (18) via the ratchet member (25) such that rotation of the drive lever (14) in one sense about axis (22) applies torque to the engaging member (18) and rotation of the drive lever (14) in the opposite sense applies torque below a predetermined value to the engaging member (18). A connecting member (12) is pivotably connected to the drive lever (14) remote from the engaging member (18) and is adapted to be engaged by a head (10) of a piston (6) having reciprocating linear movement to alternately rotate the drive lever (14) in opposite senses about axis (22). The connecting member (12) is slidable relative to the piston head (10) in a direction transverse to the direction of reciprocal linear movement.

39 Claims, 4 Drawing Sheets

TORQUE WRENCH

The present application claims the priority of a United Kingdom patent filed Jun. 13, 2000 under application number 0014416.2.

This application is a 371 of PCT/GB01/02651 filed Jun. 8, 2001.

The present invention relates to torque wrenches, and relates particularly, but not exclusively, to hydraulic torque wrenches for tightening and loosening threaded connectors.

Hydraulic torque wrenches generally comprise an actuator unit including a hydraulic cylinder and piston, the free end of the piston being pivotally connected to a drive lever which engages the connector to be rotated, either directly or by means of an intermediate component having one end which fits the drive lever and another end which fits the connector. Reciprocal linear movement of the piston causes the drive lever to rotate in alternating senses about an axis about which the connector is to be rotated, and a ratchet mechanism causes rotation of the lever in one sense only to apply a substantial level torque to the connector.

Known torque wrenches suffer from the drawback that as the drive lever rotates as a result of reciprocating linear movement of the piston, the distance between the line of action of the force supplied by the piston and the axis of rotation of the drive lever varies. As a result, the stroke of the piston must be kept short, which significantly increases the time taken to tighten or loosen a connector, or compensation for the change in distance must be made.

Known torque wrenches in which compensation as referred to above is provided are disclosed in U.S. Pat. No. 4,027,561 and EP0382961. Such torque wrenches accommodate for variations in the distance between the axis of rotation of the drive lever and the line of action of the force applied by the piston by making the hydraulic cylinder and piston arrangement pivotable about an end thereof remote from the end attached to the drive lever. This enables the end of the cylinder attached to the drive lever to move with the drive lever. However, this type of torque wrench suffers from the drawback that for safety reasons. the housing of the wrench must be bulky to accommodate the entire locus of positions of the cylinder and piston arrangement.

Preferred embodiments of the present invention seek to overcome the above disadvantages of the prior art.

According to the present invention, there is provided a torque wrench for applying torque to a component, the torque wrench comprising:

an engaging member for engaging a component to be rotated about an axis;

ratchet means connected to said engaging member;

a lever connected to said engaging member via said ratchet means such that rotation of said lever in-one sense about said axis applies torque to said engaging member and rotation of said lever in the opposite sense about said axis applies torque below a predetermined value to said engaging member; and a connector member pivotably connected to said lever remote from said engaging member and adapted to be engaged by actuator means having reciprocating linear movement in use, to alternately rotate the lever in opposite senses about said axis;

wherein said connector member in use is slidable relative to said actuator means in a direction transverse to the direction of said reciprocal linear movement.

By providing a connector member slidable relative to the actuator means in a direction transverse to the direction of reciprocal linear motion, this provides the advantage that force can be transferred from the actuator means to the connector member for all positions of the lever without the necessity of pivoting of the actuator means about its end remote from the connector member. This enables the torque wrench to be constructed more compactly than in the case of the prior art.

In a preferred embodiment, the engaging member defines an aperture adapted to engage a component to be rotated, and is provided with first engaging means on an outer surface thereof adapted to engage said ratchet means.

The first engaging means may comprise a plurality of teeth.

In a preferred embodiment, the ratchet means includes second engaging means adapted to engage said first engaging means to allow sliding relative movement of said first and second engaging means in one direction only.

The ratchet means may further comprise biassing means for urging said second engaging means into engagement with said first engaging means.

The lever and said connector member are preferably provided with mutually engaging surfaces.

This provides the advantage of maximising the area over which force is applied to the connector member by the actuator means, which in turn minimises localised stresses in the torque wrench.

The mutually engaging surfaces may comprise a convex surface on one of said lever and said engaging member and a cooperating concave surface on the other of said lever and said engaging member.

The connector member may comprise an engaging portion for engaging said actuator means to allow sliding relative movement of said engaging member and said actuator means in a direction transverse to the direction of said reciprocating linear movement but not in a direction substantially parallel to that of said reciprocating linear movement.

This provides the advantage of enabling the movement of the actuator means in both directions to be transmitted to the connector member, while allowing sliding relative movement of the connector member and actuator means in a direction transverse to the direction of reciprocating linear movement.

The torque wrench may further comprise actuator means having reciprocating linear movement in use, to alternately rotate the lever in opposite senses about said axis.

The actuator means may be separable from said lever and said connector member.

This provides the advantage of enabling the torque wrench to be provided with a plurality of engaging members of different sizes to fit connectors of various sizes.

The engaging portion preferably comprises at least one slot or projection adapted to engage a respective projection or recess on said actuator means.

In a preferred embodiment, the or each said projection is displaceable and is adapted to slide over an inclined surface to engage the corresponding said recess.

This provides the advantage of minimising the risk of movement of the lever across the entire stroke of the actuator means when the connector member is not correctly engaged with the actuator means, which could otherwise damage the torque wrench.

The actuator means may include a hydraulic piston and cylinder.

Preferred embodiments of the invention will now be described, by way of example only and not in any limitative sense, with reference to the accompanying drawings in which.

Figure 1:
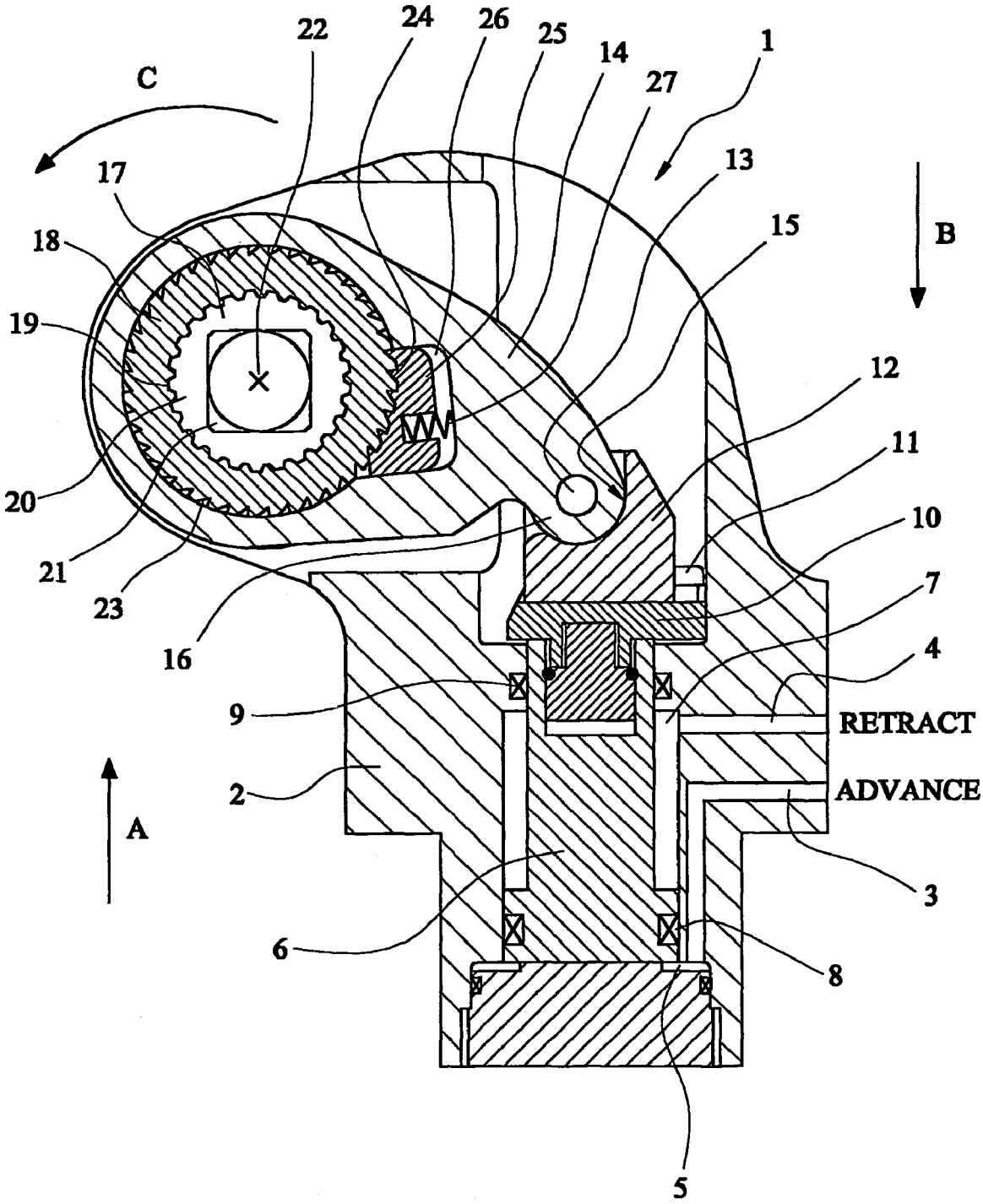
FIG. 1 is a cross-sectional side view of a first embodiment of the present invention.

Referring to FIG. 1, a torque wrench 1 has a housing 2 provided with first 3 and second 4 inlet ports for hydraulic fluid (not shown). First inlet port 3 communicates with an annular chamber 5 to cause a piston 6 to slide in the direction of arrow A in a chamber 7 to which the piston 6 is mounted via seals 8, 9. Second inlet port 4 communicates directly with chamber 7 to cause the piston 6 to move in the direction of arrow B.

A head 10 of piston 6 is provided with a groove 11 which receives a connecting member 12 which is pivotably mounted via a pin 13 to a drive lever 14. The connecting member 12 and drive lever 14 are provided respectively with cooperating concave 15 and convex 16 surfaces which remain substantially in contact with each other as the connecting member 12 and drive lever 14 pivot relative to each other about pin 13. This maximizes the surface area over which force in the direction of arrow A is applied to the drive lever 14, which in turn minimises localised stress at that part of the drive lever 14.

The drive lever 14 defines an aperture 17 in which is received an annular engaging member 18 having teeth 19 on its inner surface for engaging an adaptor 20 which in turn is connected to a component 21 to be rotated about axis 22. The engaging member 18 is provided on its outer surface with teeth 23 which engage corresponding teeth 24 on ratchet member 25, the profile of the teeth being such that the engaging member 18 is able to rotate in the direction of arrow C in FIG. 1 but not in the opposite direction. The ratchet member 25 is provided in a recess 26 in the drive lever 14 and is urged into engagement with the engaging member 18 by compression spring 27. It can therefore be seen that rotation of drive lever 14 in the direction of arrow C about axis 22 causes engaging member 18 to also rotate about axis 22 to apply torque to the component 21, whereas rotation of the driver lever 14 in the opposite sense does not cause engaging member 18 to rotate the component 21.

The operation of the embodiment shown in FIG. 1 will now be described.

In order to apply torque in the direction of arrow C in FIG. 1 to the component 21, hydraulic fluid is applied in the forward stroke of the piston 6 via first inlet port 3 to cause movement of hydraulic piston 6 in the direction of arrow A. Movement of the piston 6 in the direction of arrow A causes rotation of drive lever 14 in the direction of arrow C about axis 22 to in turn cause rotation of engaging member 18 in the direction of arrow C about axis 22. As drive lever 14 rotates about axis 22, the distance between the line of action of the force applied by piston 6 and the axis 22 changes. At the same time, however, the connecting member 12 slides in groove 11 relative to the head 10 of piston 6 so that a force parallel to arrow A can still be applied to the convex surface 16 of drive lever 14.

In the return stroke of the piston 6, hydraulic fluid is supplied via second inlet port 4 to move the piston 6 in the direction of arrow B. this causes drive lever 14 to rotate about axis 22 in a direction opposite to arrow C, but because of sliding movement between the teeth 23 of engaging member 18 relative to the teeth 24 of ratchet member 25, the engaging member 18 is not caused to rotate about axis 22 relative to the drive lever 14. In this way, the reciprocating movement of piston 6 causes torque to be applied to the component 21 with each forward stroke of the piston 6.

Figure 2:
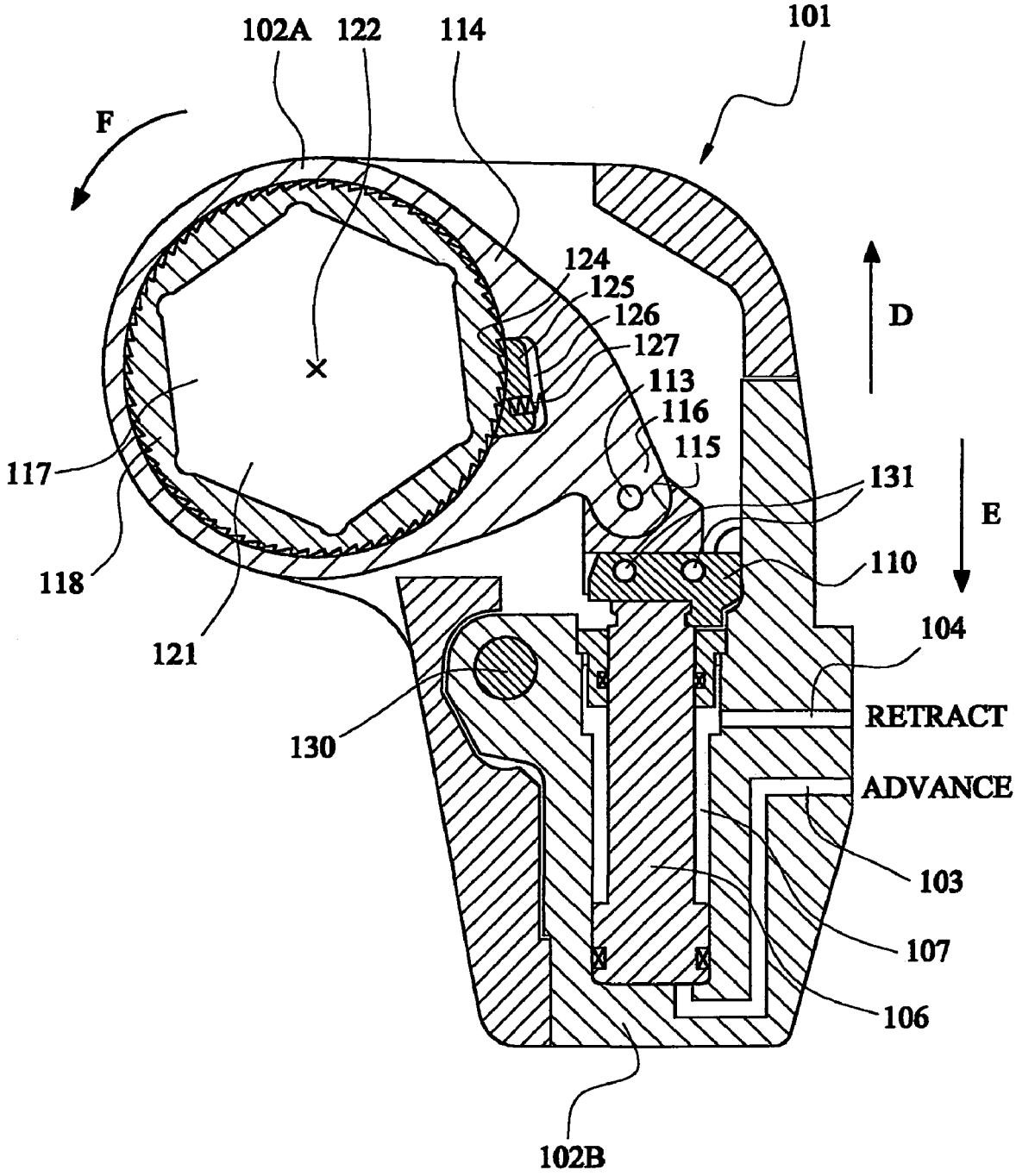
FIG. 2 is a cross-sectional side view of a second embodiment of the invention in an assembled condition.
Figure 3:
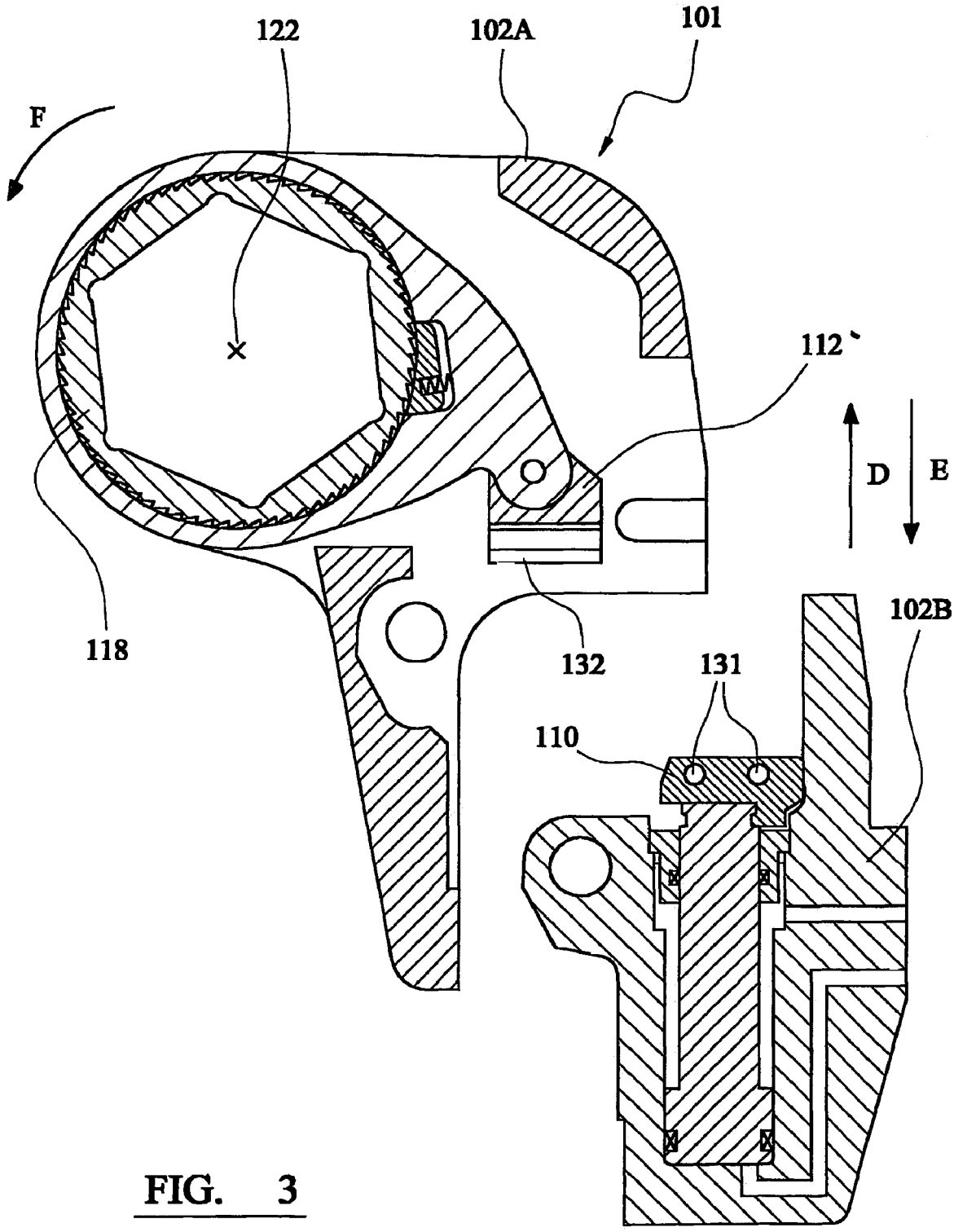
FIGS. 3 and 3A are cross-sectional/side views of the embodiment of FIG. 2 in a separated condition.

Referring to FIGS. 2 and 3, in which parts common to the embodiment of FIG. 1 are denoted by like reference numerals but increased by 100, housing 102A, 102B of the wrench 101 is provided in two parts which are separable from each other and can be locked to each other by means of a pin 130. The housing part 102A includes drive lever 114 and connecting member 112, as well as engaging member 118 and ratchet member 125. It can be seen from FIG. 3 that the engaging member 118 defines an internal aperture 117 adapted to directly engage a hexagonal nut 121 to be turned.

Figure 3A:
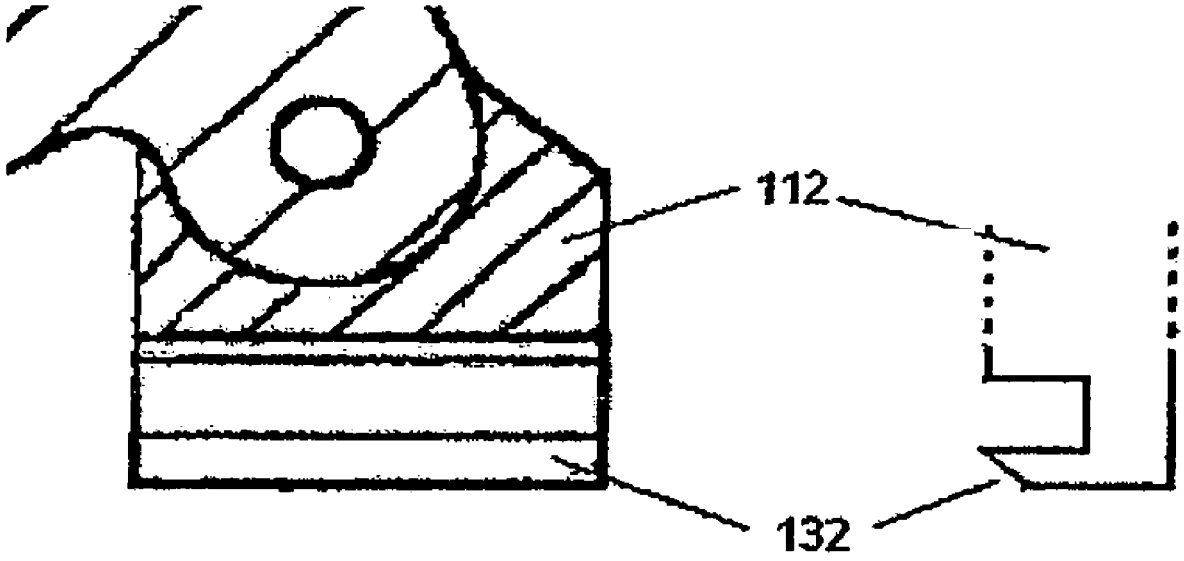

Housing part 102B contains hydraulic piston 106, as well as the head 110 of piston 106. The head 110 of piston 106 is provided with a pair of spring loaded, displaceable pins 131 which are adapted to engage an inclined edge part 132 (FIG. 3) of connecting member 112. The inclined edge part 132 is arranged such that as the piston head 110 and connecting member 112 are brought into contact with each other, the pins 131 are displaced inwardly of the piston head 110 by the inclined surface of edge part 132 to enable the pins 131 to lock behind edge part 132 such that movement of the piston head 110 in the direction of arrow D or E in FIGS. 2 and 3 causes the connecting member 112 to also be displaced in that direction. Note also FIG. 3A.

The operation of the torque wrench 101 shown in FIGS. 2 and 3 will now be described.

In order to apply torque in the direction of arrow F in FIGS. 2 and 3 to a hexagonal nut 121, housing part 102A having an engaging member 118 of the correct size aperture 117 is selected from a set of such housing parts 102A having apertures 117 of various sizes. The housing part 102A is then brought together with the housing part 102B such that the connecting member 112 engages pins 131 to lock the connecting member 112 and piston head 110 together, but allows sliding relative movement between these two parts in a direction transverse to arrows D and E.

The engaging member 118 is then mounted to the nut 121, and hydraulic fluid is supplied via first inlet port 103. This causes displacement of the piston head 110 in the direction of arrow D, which in turn causes rotation of the drive lever 114 in the direction of arrow F to rotate the nut 121 in that direction about axis 122. At the return stroke of piston 106, sliding relative movement can occur between the engaging member 118 and ratchet member 125 as the drive lever 114 rotates in the direction opposite to arrow F. Accordingly, no significant level of torque is applied to the nut 121 in the direction opposite to arrow F. The process is then repeated until the desired amount of rotation/torque is applied to the nut 121.

It will be appreciated by persons skilled in the art that the above embodiments have been described by way of example only and not in any limitative sense, and that various alterations and modifications are possible without departure from the scope of the invention as defined by the appended claims.

The invention claimed is:

1. A torque wrench for applying torque to a component, the torque wrench comprising:

an engaging member for engaging a component to be rotated about an axis;

at least one ratchet connected to said engaging member;

a lever connected to said engaging member via said at least one ratchet such that rotation of said lever in one sense about said axis applies torque to said engaging member and rotation of said lever in the opposite sense about said axis applies torque below a predetermined value to said engaging member; and a connector member pivotably connected to said lever remote from said engaging member and adapted to be engaged by at least one actuator having reciprocating linear movement in use, to alternately rotate said lever in opposite senses about said axis;

wherein said lever in use abuts said connector member, and sad connector member in use is slidable relative to said at least one actuator in a direction transverse to the direction of said reciprocating linear movement such that said connector member applies a force to said lever only in a direction parallel to said reciprocating linear movement throughout said reciprocating linear movement.

2. A torque wrench according to claim 1, wherein said engaging member defines an aperture adapted to engage a component to be rotated, and is provided with at least one first engaging portion on an outer surface thereof adapted to engage said at least one ratchet.

3. A torque wrench according to claim 2, wherein said at least one first engaging portion composes a plurality of teeth.

4. A torque wrench according to claim 2, wherein said at least one ratchet includes at least one second engaging portion adapted to engage a respective said first engaging portion to allow sliding relative movement of said first and second engaging portions in one direction only.

5. A torque wrench according to claim 4, wherein said at least one ratchet further comprises a biasing device for urging said at least one second engaging portion into engagement with said at least one first engaging portion.

6. A torque wrench according to claim 1, wherein said lever and said connector member are provided with mutually engaging surfaces.

7. A torque wrench according to claim 6, wherein said mutually engaging surfaces comprise a convex surface on one of said lever and said connector member and a cooperating concave surface on the other of said lever and said connector member.

8. A torque wrench according to claim 4, wherein said connector member comprises a third engaging portion for engaging said at least one actuator to allow sliding relative movement of said connector member and said actuator in a direction transverse to the direction if said reciprocating linear movement but not in a direction substantially parallel to that of said reciprocating linear movement.

9. A torque wrench according to claim 8, wherein said third engaging portion comprises at least one recess adapted to engage a respective projection on said at least one actuator or at least one projection adapted to engage a respective recess on said at least one actuator.

10. A torque wrench according to claim 9, wherein said at least one projection is displaceable and is adapted to slide over an inclined surface of said connector member or of said actuator, respectively to engage the corresponding said recess.

11. A torque wrench according to claim 1, further comprising at least one actuator having reciprocating linear movement in use, to alternately rotate said lever in opposite senses about said axis.

12. A torque wrench according to claim 11, wherein said at least one actuator is separable from said lever and said connector member.

13. A torque wrench according to claim 9, wherein said at least one actuator includes a hydraulic piston and cylinder.

14. A method for applying torque to a component, the method comprising:

applying torque to a component utilizing a wrench;

wherein the wrench includes an engaging member for engaging a component to be rotated about an axis; at least one ratchet connected to said engaging member; a lever connected to said engaging member via said at least one ratchet such that rotation of said lever in one sense about said axis applies torque to said engaging member and rotation of said lever in the opposite sense about said axis applies torque below a predetermined value to said engaging member; and a connector member pivotably connected to said lever remote from said engaging member and adapted to be engaged by at least one actuator having reciprocating linear movement in use, to alternately rotate said lever in opposite senses about said axis; wherein said lever in use abuts said connector member, and said connector member in use is slidable relative to said at least one actuator in a direction transverse to the direction of said reciprocating linear movement such that said connector member applies a force to said lever only in a direction parallel to said reciprocating linear movement throughout said reciprocating linear in movement.

15. A torque wrench for applying torque to a component, the torque wrench comprising:

an engaging member for engaging a component to be rotated about an axis;

at least one ratchet connected to said engaging member;

a lever connected to said engaging member via said at least one ratchet such that rotation of said lever in one sense about said axis applies torque to said engaging member and rotation of said lever in the opposite sense about said axis applies torque below a predetermined value to said engaging member; and a connector member pivotably connected to said lever remote from said engaging member and adapted to be engaged by at least one actuator having reciprocating linear movement in use, to alternately rotate said lever in opposite senses about said axis;

wherein said lever in use abuts said connector member, and said connector member in use is linearly slidable relative to said at least one actuator in a direction transverse to the direction of said reciprocating linear movement.

16. A torque wrench according to claim 15, wherein said engaging member defines an aperture adapted to engage a component to be rotated, and is provided with at least one first engaging portion on an outer surface thereof adapted to engage said at least one ratchet.

17. A torque wrench according to claim 16, wherein said at least one first engaging portion comprises a plurality of teeth.

18. A torque wrench according to claim 16, wherein said at least one ratchet includes at least one second engaging portion adapted to engage a respective said first engaging portion to allow sliding relative movement of said first and second engaging portions in one direction only.

19. A torque wrench according to claim 18, wherein said at least one ratchet further comprises a biasing device for urging said at least one second engaging portion into engagement with said at least one first engaging portion.

20. A torque wrench according to claim 15, wherein said lever and said connector member are provided with mutually engaging surfaces.

21. A torque wrench according to claim 20, wherein said mutually engaging surfaces comprise a convex surface on one of said lever and said connector member and a cooperating concave surface on the other of said lever and said connector member.

22. A torque wrench according to claim 18, wherein said connector member comprises a third engaging portion for engaging said at least one actuator to allow sliding relative movement of said connector member and said actuator in a direction transverse to the direction of said reciprocating, linear movement but not in a direction substantially parallel to that of said reciprocating linear movement.

23. A torque wrench according to claim 22, wherein said third engaging portion comprises at least one recess adapted to engage a respective projection on said at least one actuator or at least one projection adapted to engage a respective recess on said at least one actuator.

24. A torque wrench according to claim 23, wherein said at least one projection is displaceable and is adapted to slide over an inclined surface of said connector member or of said actuator, respectively to engage the corresponding said recess.

25. A torque wrench according to claim 15, further comprising at least one actuator having reciprocating linear movement in use to alternately rotate said lever in opposite senses about said axis.

26. A torque wrench according to claim 25, wherein said at least one actuator is separable from said lever and said connector member.

27. A torque wrench according to claim 23, wherein said at least one actuator includes a hydraulic piston and cylinder.

28. A method for applying torque to a component, the method comprising:

applying torque to a component utilizing a wrench;

wherein the wrench includes an engaging member for engaging a component to be rotated about an axis; at least one ratchet connected to said engaging member; a lever connected to said engaging member via said at least one ratchet such that rotation of said lever in one sense about said axis applies torque to said engaging member and rotation of sad lever in the opposite sense about said axis applies torque below a predetermined value to said engaging member; and a connector member pivotably connected to said lever remote from said engaging member and adapted to be engaged by at least one actuator having reciprocating linear movement in use, to alternately rotate said lever in opposite senses about said axis; wherein said lever in use abuts said connector member, and said connector member in use is linearly slidable relative to said at least one actuator in a direction transverse to the direction of said reciprocating linear movement.

29. A torque wrench for applying torque to a component, the torque wrench comprising:

an engaging member for engaging a component to be rotated about an axis;

at least one ratchet connected to said engaging member;

a lever connected to said engaging member via said at least one ratchet such that rotation of said lever in one sense about said axis applies torque to said engaging member and rotation of said lever in the opposite sense about said axis applies torque below a predetermined value to said engaging member; and a connector member pivotably connected to said lever remote from said engaging member and adapted to be engaged by at least one actuator having reciprocating linear movement in use, to alternately rotate said lever in opposite senses about said axis:

wherein said lever in use abuts said connector member, and said connector member in use is slidable relative to said at least one actuator in a direction transverse to the direction of said reciprocating linear movement and wherein said connector member comprises a third engaging portion for engaging said at least one actuator to allow sliding relative movement of said connector member and said actuator in a direction transverse to the direction of said reciprocating linear movement but not in a direction substantially parallel to that of said reciprocating linear movement, said third engaging portion comprises at least one recess adapted to engage a respective projection on said at least one actuator or at least one projection adapted to engage a respective recess on said at least one actuator and said at least one projection is displaceable and is adapted to slide over an inclined surface of said connector member or of said actuator, respectively to engage the corresponding said recess.

30. A torque wrench according to claim 29, wherein said engaging member defines an aperture adapted to engage a component to be rotated, and is provided with at least one first engaging portion on an outer surface thereof adapted to engage said at least one ratchet.

31. A torque wrench according to claim 30, wherein said at least one first engaging portion comprises a plurality of teeth.

32. A torque wrench according to claim 30, wherein said at least one ratchet includes at least one second engaging portion adapted to engage a respective said first engaging portion to allow sliding relative movement of said first and second engaging portions in one direction only.

33. A torque wrench according to claim 32, wherein said at least one ratchet further comprises a biasing device for urging said at least one second engaging portion into engagement with said at least one first engaging portion.

34. A torque wrench according to claim 29, wherein said lever and said connector member are provided with mutually engaging surfaces.

35. A torque wrench according to claim 34, wherein said mutually engaging surfaces comprise a convex surface on one of said lever and said connector member and a cooperating concave surface on the other of said lever and said connector member.

36. A torque wrench according to claim 29, further comprising at least one actuator having reciprocating linear movement in use, to alternately rotate said lever in opposite senses about said axis.

37. A torque wrench according to claim 36, wherein said at least one actuator is separable from said lever and said connector member.

38. A torque wrench according to claim 29, wherein said at least one actuator includes a hydraulic piston and cylinder.

39. A method for applying torque to a component, the method comprising:

applying torque to a component utilizing a wrench;

wherein the wrench includes an engaging member for engaging a component to be rotated about an axis; at least one ratchet connected to said engaging member; a lever connected to said engaging member via said at least one ratchet such that rotation of said lever in one sense about said axis applies torque to said engaging member and rotation of said lever in the opposite sense about said axis applies torque below a predetermined value to said engaging member; and a connector member pivotably connected to said lever remote from said engaging member and adapted to be engaged by at least one actuator having reciprocating linear movement in use, to alternately rotate said lever in opposite senses about said axis; wherein said lever in use abuts said connector member; and said connector member in use is slidable relative to said at least one actuator in a direction transverse to the direction of said reciprocating linear movement and wherein said connector member comprises a third engaging portion for engaging said at least one actuator to allow sliding relative movement of said connector member and said actuator in a direction transverse to the direction of said reciprocating linear movement but not in a direction substantially parallel to that of said reciprocating linear movement, said third engaging portion comprises at least one recess adapted to engage a respective projection on said at least one actuator or at least one projection adapted to engage a respective recess on said at least one actuator and said at least one projection is displaceable and is adapted to slide over an inclined surface of said connector member or of said actuator, respectively to engage the corresponding said recess.

* * * * *

UNITED STATES PATENT AND TRADEMARK OFFICE

CERTIFICATE OF CORRECTION

PATENT NO. : 7,168,341 B2
APPLICATION NO. : 10/311173
DATED : January 30, 2007
INVENTOR(S) : More It is certified that error appears in the above-identified patent and that said Letters Patent is hereby corrected as shown below:

In the claims:

Col. 5, line 9, please replace “sad” with --said--;
Col. 5, line 22, please replace “composes” with --comprises--;
Col. 5, line 44, please replace “if” with --of--;
Col. 7, line 23, please replace “use” with --use,--;
Col. 7, line 39, please replace “sad” with --said--;
Col. 7, line 66, please replace “axis:” with --axis;--;
Col. 9, line 4, please replace “member;” with --member,--.

Signed and Sealed this
Twelfth Day of July, 2011

David J. Kappos

David J. Kappos
*Director of the United States Patent and Trademark Office*